US007740049B2

(12) United States Patent
Sakurai et al.

(10) Patent No.: US 7,740,049 B2
(45) Date of Patent: Jun. 22, 2010

(54) MOLD DEVICE AND METHOD OF MANUFACTURING CYLINDER BLOCK

(75) Inventors: Akira Sakurai, Shimotsuke (JP); Hajime Miyasaka, Tochigi-ken (JP); Yoshimichi Asai, Kawagoe (JP); Hiroyuki Ohashi, Utsunomiya (JP); Kazumi Nagao, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 625 days.

(21) Appl. No.: 11/630,034

(22) PCT Filed: Apr. 25, 2005

(86) PCT No.: PCT/JP2005/007784

§ 371 (c)(1),
(2), (4) Date: Dec. 19, 2006

(87) PCT Pub. No.: WO2005/123300

PCT Pub. Date: Dec. 29, 2005

(65) Prior Publication Data

US 2008/0274289 A1 Nov. 6, 2008

(30) Foreign Application Priority Data

Jun. 21, 2004 (JP) ..... 2004-182111

(51) Int. Cl.
*B22D 29/00* (2006.01)
*B22D 33/04* (2006.01)
*B22C 9/10* (2006.01)

(52) U.S. Cl. ..... 164/137; 164/132; 164/339; 164/342; 164/369

(58) Field of Classification Search ..... 164/69.1, 164/132, 340, 346, 400, 421, 465, 342, 369; 29/888.01, 888.06, 527.3
See application file for complete search history.

(56) References Cited

U.S. PATENT DOCUMENTS

| | | | | |
|---|---|---|---|---|
| 4,286,766 | A * | 9/1981 | von Holdt | 249/144 |
| 5,529,027 | A * | 6/1996 | Okubo | 123/41.01 |
| 6,615,901 | B2 | 9/2003 | Kaminski et al. | |
| 2002/0153120 | A1 | 10/2002 | Ito et al. | |

FOREIGN PATENT DOCUMENTS

| | | | |
|---|---|---|---|
| EP | 1 243 363 | A2 | 9/2002 |
| JP | 57-189640 | U | 12/1982 |
| JP | 2-42735 | U | 3/1990 |
| JP | 2001-205391 | | 7/2001 |
| JP | 2002-283003 | A | 10/2002 |
| JP | 3406266 | B2 | 3/2003 |
| JP | 2003-170246 | A | 6/2003 |
| JP | 2004-025248 | A | 1/2004 |

* cited by examiner

*Primary Examiner*—Jessica L. Ward
*Assistant Examiner*—Kevin E Yoon
(74) *Attorney, Agent, or Firm*—Arent Fox LLP

(57) ABSTRACT

A method of manufacturing a cylinder block using a die apparatus wherein a columnar hole includes a bore in the cylinder block. The method includes the steps of abutting first and second split cores against an upper surface of a distal end core, the upper surface being located opposite the inner core, and introducing a molten metal into a cavity. An inner core is withdrawn to move the first and second split cores toward an axis. The first and second split cores are released from a formed product made of solidified molten metal. The split cores are removed from the formed product to form the bore, and an inner surface of the bore is cut.

3 Claims, 14 Drawing Sheets

MOLD DEVICE AND METHOD OF MANUFACTURING CYLINDER BLOCK

CROSS-REFERENCE TO RELATED APPLICATION

This application is a National Stage entry of International Application No. PCT/JP2005/007784, filed Apr. 25, 2005, the entire specification claims and drawings of which are incorporated herewith by reference.

TECHNICAL FIELD

The present invention relates to a die apparatus having a split core for forming a columnar hole, and a method of manufacturing a cylinder block with the die apparatus.

BACKGROUND ART

For manufacturing a cast product having a columnar hole such as a bore in an engine cylinder block, it is customary to insert a core into a cavity of a casting die, cast a molten metal into the cavity, remove the core after the molten metal is solidified, and release the casting from the die, so that the casting with a columnar hole defined therein is produced. In order to remove the core smoothly, the core needs to have a certain draft angle for removal. However, since the bore has to be of a gradient-free cylindrical shape, it is necessary to cut the casting depending on the draft angle. If the draft angle is large or the columnar hole is deep, then the amount of material machined off the casting is large when the casting is cut, the time required to cut the casting is long, and many chips are produced, resulting in a reduction in the rate of utilization of the material. Generally, castings tend to contain more blowholes in deeper regions from the surface. Therefore, if a large amount of material is machined off the casting, then many blowholes are liable to appear in the cut surface of the casting.

The amount of material machined off the casting should preferably be small, and the draft angle of the core should desirably be zero. To meet these demands, there has been proposed a die apparatus having a core which comprises an inner member and an outer member whose tapered surfaces are slidably supported on opposite side surfaces of the inner member (see, for example, Patent No. 3406266 (Japan)).

The proposed die apparatus allows the core to be removed smoothly while being kept out of interference with the bottom wall of a space in the product. Only a side core member of the core is movable radially inwardly for removal of the core. Therefore, the side core member does not require a draft angle on its outer circumferential surface. However, if the columnar hole is deep, then though the side core member is releasable, another core member may not be releasable and needs to have a draft angle.

For using a casting as an engine cylinder block, the casting should preferably be processed by a hard coating process in view of sliding movement of pistons. However, if the casting has a draft angle, then after the inner surface of the casting is cut, blowholes appear on the cut inner surface and may possibly prevent a hard coating process from being properly performed on the inner surface. When a casting is heated, the surface of the casting may possibly be unduly deformed due to blowholes that are present on or near the surface of the casting.

DISCLOSURE OF THE INVENTION

The present invention has been made in view of the above drawbacks. It is an object of the present invention to provide a die apparatus having a split core assembly for forming a columnar hole in a casting, the die apparatus being capable of smoothly releasing the split core assembly without the need for a draft angle thereby to form a columnar hole, and a method of manufacturing a cylinder block with the die apparatus.

Another object of the present invention is to provide a die apparatus for preventing blowholes from developing on or near a surface of a casting when the surface of the casting is cut, thereby allowing the casting to be properly processed by a hard coating process and a heating process, and a method of manufacturing a cylinder block with the die apparatus.

A die apparatus according to the present invention comprises a split core assembly to be inserted into a cavity in a casting die for forming a columnar hole in a casting, the split core assembly comprising a plurality of first split cores having at least distal end portions tapered in directions away from an axis of the columnar hole in a cross section extending perpendicular to the axis, a plurality of second split cores disposed between the first split cores as viewed from the axis, and an inner core including the axis, for pushing and positioning at least the first split cores in directions away from the axis, wherein when the first split cores are positioned by the inner core, each of the second split cores has opposite ends held in abutment against the distal end portions of adjacent ones of the first split cores, and outer circumferential surfaces of the first split cores and outer circumferential surfaces of the second split cores form an inner circumferential surface shape of the columnar hole.

As described above, the outer circumferential surfaces of the first split cores and outer circumferential surfaces of the second split cores form the inner circumferential surface shape of the columnar hole, and, after the molten metal is introduced into the cavity, the first split cores and the second split cores are moved toward the axis. The first split cores and the second split cores are free of draft angles, and the split core assembly can smoothly be released and removed. Since the distal end portions of the first split cores are tapered, the first split cores can be moved inwardly without interference with the second split cores. The second split cores can be moved after the first split cores are moved.

The die apparatus may further comprise a first stopper for preventing the first split cores and the second split cores from moving in a direction toward a bottom of the columnar hole, the first split cores having inner slanted surfaces which are progressively closer to the axis in the direction toward the bottom, the inner core having outer slanted surfaces facing the inner slanted surfaces and inclined at the same angle as the inner slanted surfaces, wherein when the inner core is pushed in the direction toward the bottom, the first split cores are pushed and positioned in the directions away from the axis while the inner slanted surfaces are sliding against the outer slanted surfaces of the inner core.

With the above arrangement, the first split cores are appropriately positioned simply by moving the inner core in the direction toward the bottom, and the first split cores are held in abutment against the inner core through a wide area and hence are stabilized.

If the first stopper comprises a distal end core held in contact with sides of the first split cores and the second split cores which are closer to the bottom, then a product of smooth shape can be formed which is free of flash on its bottom surface.

The die apparatus may further comprise a second stopper for preventing the first split cores and the second split cores from being pulled out of the columnar hole, either the first split cores or the inner core having first engaging grooves progressively closer to the axis in the direction toward the bottom, and another of the first split cores and the inner core having first engaging members engaging and movable in the first engaging grooves, either the second split cores or the inner core having second engaging grooves progressively closer to the axis in the direction toward the bottom, and another of the second split cores and the inner core having second engaging members engaging and movable in the second engaging grooves, wherein after a molten metal is introduced into the cavity, the inner core is withdrawn to cause the first engaging members and the second engaging members to move respectively in the first engaging grooves and the second engaging grooves, and the first split cores and the second split cores are attracted in directions toward the axis and released from a formed product.

Consequently, the first split cores and the second split cores can be released from the formed product simply by withdrawing the inner core.

Before the inner core is withdrawn, first gaps are provided between engaging surfaces of the first engaging grooves and the first engaging members, and second gaps are provided between engaging surfaces of the second engaging grooves and the second engaging members, and when the inner core is withdrawn, the first engaging grooves and the first engaging members engage each other, and thereafter the second engaging grooves and the second engaging members engage each other. Since the first split cores and the second split cores can thus be released from the formed product at different times, the first split cores and the second split cores can easily be released, and forces applied to withdraw the inner core may be small.

If the first gaps are smaller than the second gaps, then it is easy to establish the difference between the times when the first split cores and the second split cores are released from the formed product.

The columnar hole may comprise a bore in a cylinder block, and when the first split cores are positioned by the inner core, the outer circumferential surfaces of the first split cores and the outer circumferential surfaces of the second split cores may form a cylindrical surface.

The first stopper comprises a distal end core held in contact with sides of the first split cores and the second split cores which are closer to the bottom, and the distal end core is shaped as a combustion chamber in a cylinder block. The combustion chamber can thus be of an appropriate shape.

If the first split cores comprise two first split cores, and the second split cores comprise two second split cores, then the die apparatus may of a simple structure.

A method of manufacturing a cylinder block according to the present invention employs the above die apparatus, wherein the columnar hole comprises a bore in the cylinder block, the method comprising a first step of introducing a molten metal into the cavity, a second step of withdrawing the inner core to move the first split cores and the second split cores toward the axis and release the first split cores and the second split cores from a formed product which is made of the solidified molten metal, a third step of removing the split core assembly from the formed product to form the bore, and a fourth step of cutting an inner surface of the bore.

Since the above die apparatus is employed, a bore free of draft angles can be formed, and the amount of material cut off in the fourth step may be small. The machining time is reduced, and the material utilization ratio is increased by reducing chips. Blowholes that appear on the cut surface are reduced, and a high-quality cylinder block is produced.

If the method further comprises, after the fourth step, a fifth step of performing a hard coating process on the inner surface of the bore, then the formed product has an increased sliding capability and is preferably used as a cylinder block.

BEST MODE FOR CARRYING OUT THE INVENTION

A die apparatus and a method of manufacturing a cylinder block according to an embodiment of the present invention will be described below with reference to FIGS. 1 through 14 of the accompanying drawings. The method of manufacturing a cylinder block according to the embodiment of the present invention is a method of casting a cylinder block for a single-cylinder engine. Since the cylinder block is of a structure integral with a cylinder head, it has a bore B in the form of a deep bottomed columnar hole. A die apparatus 10 according to the embodiment of the present invention is used to form the bore B.

Figure 1:
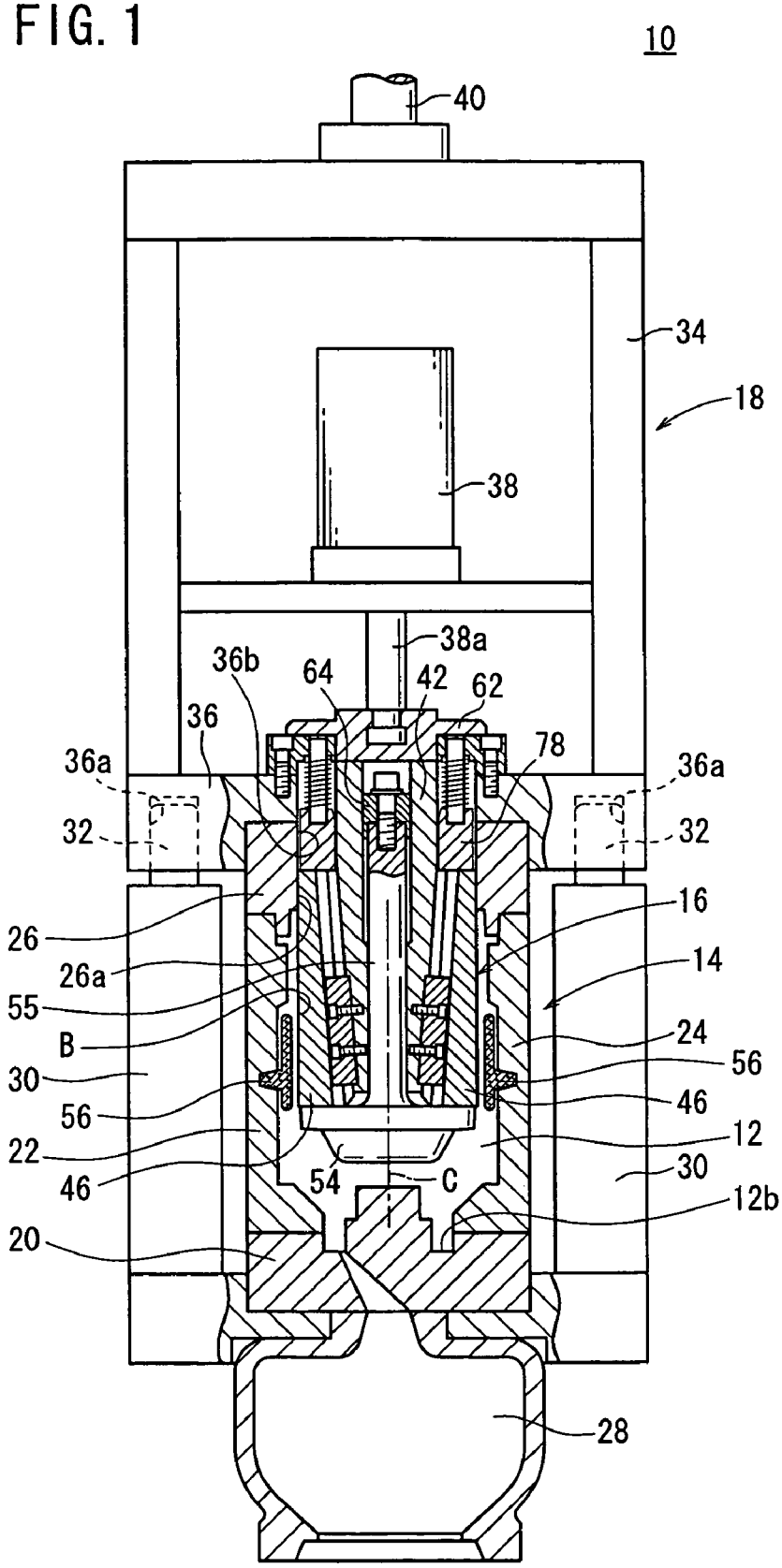
FIG. 1 is a side elevational view, partly in cross section, of a die apparatus according to an embodiment of the present invention.

As shown in FIG. 1, the die apparatus 10 has a die assembly 14 forming an outer circumferential surface of a cavity 12, a split core assembly 16 inserted in the cavity 12, and an actuating mechanism 18 for actuating the split core assembly 16 back and forth.

The die assembly 14 comprises a fixed die 20 for forming a cylinder head portion of the cylinder block, a first slidable die 22 and a second slidable die 24 for forming a surrounding portion of the cylinder block, and a movable die 26 for forming a crankcase portion of the cylinder block. A gate 28 for introducing a molten metal (including a semisolid slurry)

such as of aluminum alloy is disposed on a lower surface of the fixed die 20. The molten metal is pushed by an ejector piston, not shown, out of a tube and introduced through the gate 28 into the cavity 12. Two upwardly extending stays 30 are mounted on an upper surface of the fixed die 20, and guide pins 32 projected respectively from upper surfaces of the stays 30.

The actuating mechanism 18 comprises a housing 34, a base plate 36 mounted on a lower portion of the housing 34, a first cylinder 38 mounted centrally in the housing 34, and a second cylinder 40 (only a rod thereof is shown in FIG. 1) for vertically moving the housing 34. The first cylinder 38 has a rod 38*a* disposed coaxially with an axial center (axis) C of the bore B. The rod 38*a* has a distal end connected to an upper portion of an inner core 42 of the split core assembly 16 for vertically moving the inner core 42. The base plate 36 is connected to the movable die 26 and is vertically movable in unison with the housing 34 when the housing 34 is vertically moved by the second cylinder 40. The first cylinder 38 and the split core assembly 16 are also vertically movable in unison therewith.

In the description of the die apparatus 10 with reference to FIGS. 1 through 5, the rod 38*a* projects and a stopper 62 is held in abutment against a spring seat 86.

The base plate 36 has guide holes 36*a* defined in a lower surface thereof, and the guide pins 32 are fitted respectively in the guide holes 36*a*. The housing 34 is guided by the guide pins 32 for precisely vertical movement. The movable die 26 is connected to a lower portion of the base plate 36 such that a cylindrical hole 36*b* defined in the base plate 36 and a cylindrical hole 26*a* defined in the movable die 26 are held in vertical communication with each other. Vertical grooves 26*b*, 36*c* (see FIG. 4) are defined respectively in inner wall surfaces of the cylindrical holes 26*a*, 36*b* in vertical communication with each other. A suspension member 64 extend transversely in the vertical grooves 26*b*, 36*c*.

Figure 2:
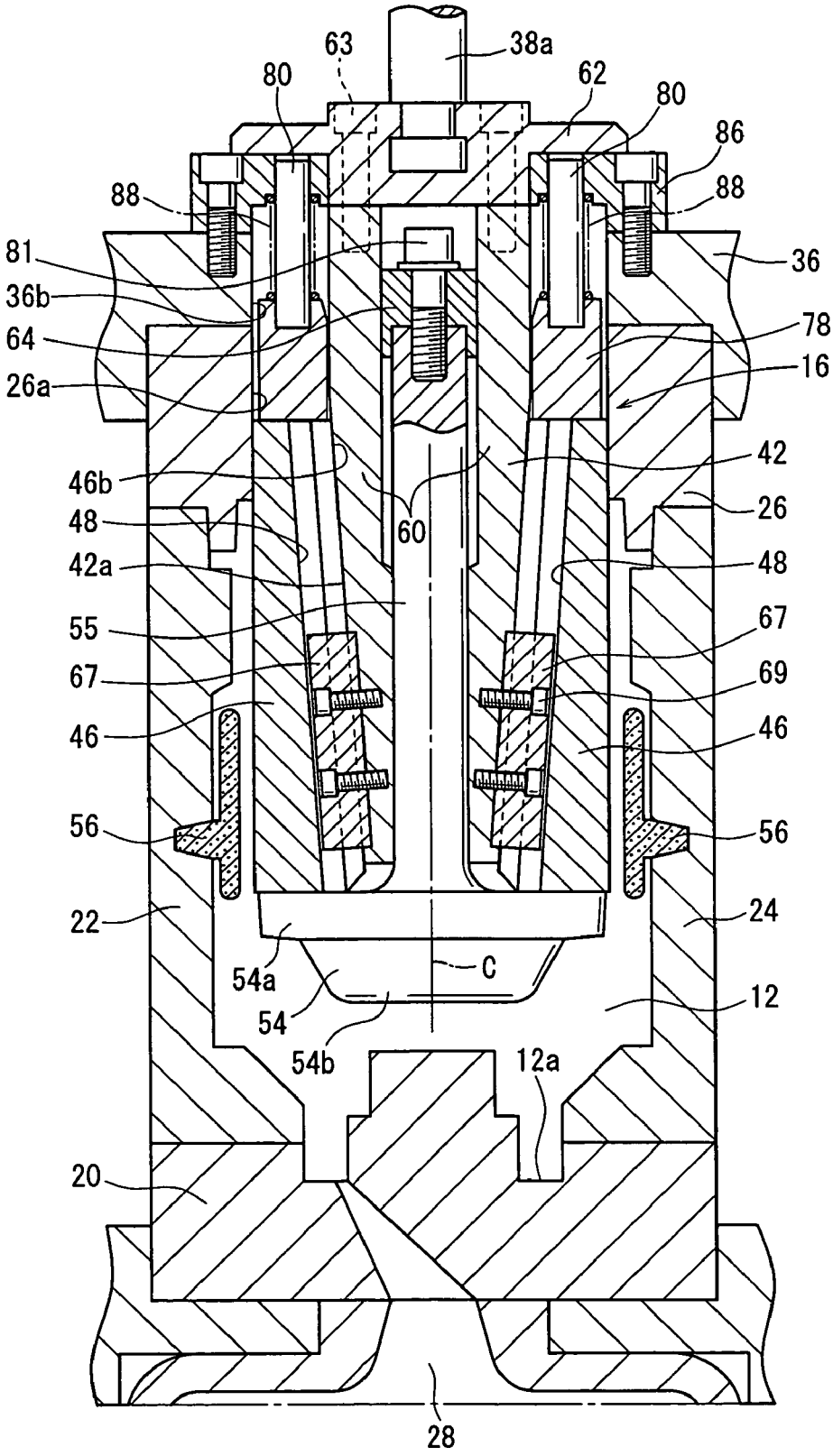
FIG. 2 is a sectional side elevational view of a fixed die, slidable dies, a movable die, and a split core assembly with an inner core being pushed out.
Figure 3:
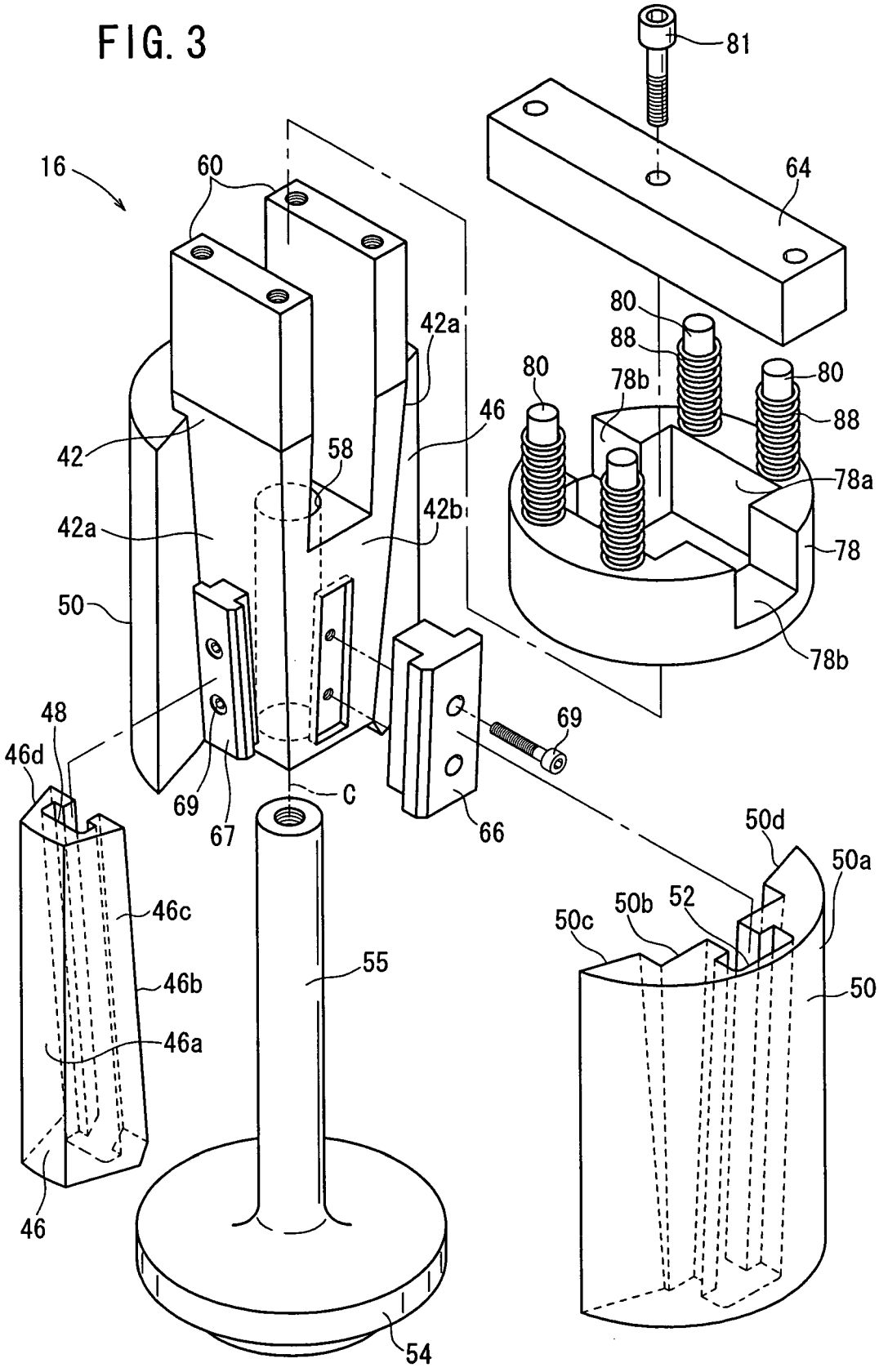
FIG. 3 is an exploded perspective view of the split core assembly.
Figure 4:
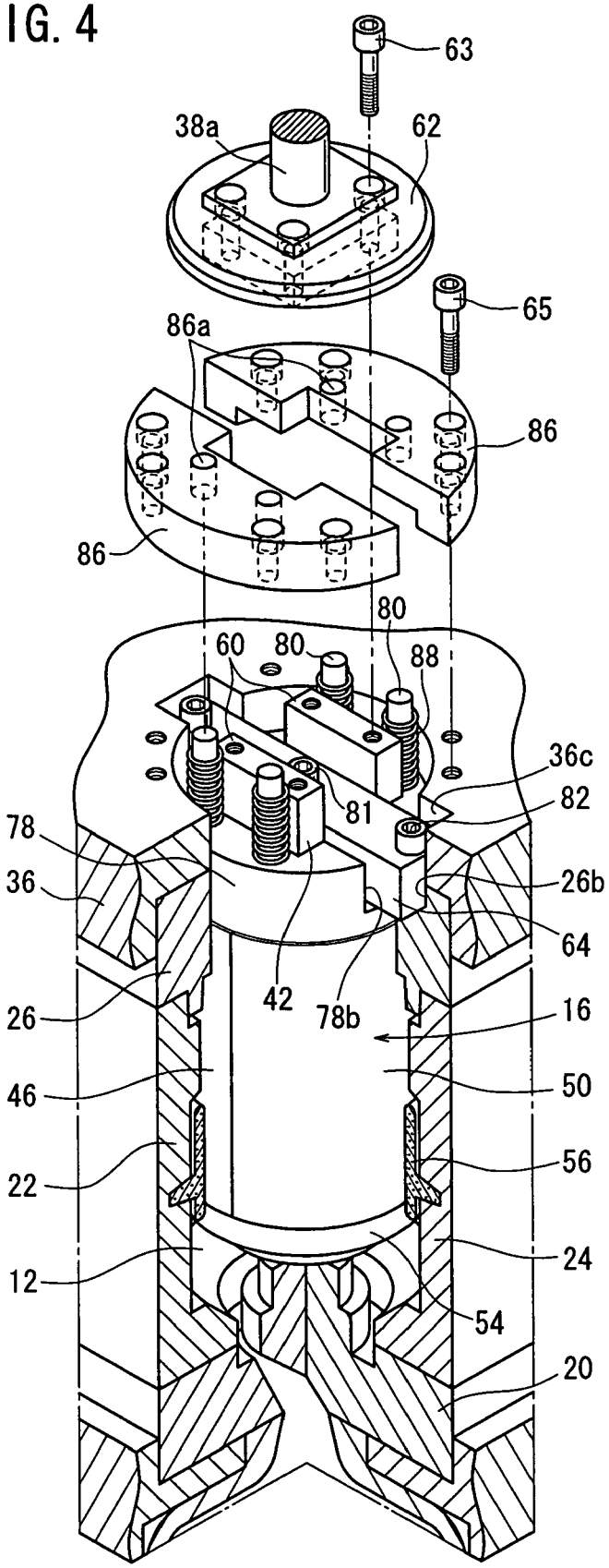
FIG. 4 is an exploded perspective view showing a joint between the split core assembly and a rod of a cylinder.

As shown in FIGS. 2 through 4, the split core assembly 16 comprises an inner core 42 extending centrally in the cavity 12 along the axial center C, two first split cores 46 and two second split cores 50 disposed in surrounding relation to the inner core 42, and a distal end core (first stopper) 54 disposed in covering relation to a substantially entire surface of the lower ends of the first and second split cores 46, 50. The distal end core 54 is of an umbrella shape and comprises a cylindrical portion 54*a* having a low axial height and a conical base portion 54*b* mounted on a lower surface of the cylindrical portion 54*a* and having a diameter which is progressively reduced downwardly. An upwardly extending pole 55 is connected centrally to an upper surface of the distal end core 54. A small gap is provided between the upper surface of the distal end core 54 and the lower surface of the inner core 42. The conical base portion 54*b* is of a smooth shape with round corners which is complementary to the combustion chamber in a cylinder. In addition to the split core assembly 16, a sand core 56 is disposed in the cavity 12 for forming a water jacket in the cylinder block, the sand core 56 having a portion fixed to the first slidable die 22 and the second slidable die 24.

The inner core 42 is of a tapered shape having a distal end portion tapered toward a bottom 12*a* of the cavity 12 and has a substantially square shape in its cross section perpendicular to the axial center C. The inner core 42 has a pair of first outer slanted surfaces 42*a* and a pair of second outer slanted surfaces 42*b*. The inner core 42 has a central hole 58 defined centrally in its cross section for the pole 55 to be inserted therein. A pair of upper side blocks 60 extends continuously from the respective first outer slanted surfaces 42*a* vertically from a substantially vertically intermediate portion of the inner core 42. The upper side blocks 60 have respective upper ends connected to the rod 38*a* by bolts 63 with the disk-shaped stopper 62 interposed therebetween. The rod 38*a* can be lowered until the stopper 62 abuts against the spring seat 86.

The first and second split cores 46, 50 are alternately disposed around the inner core 42. When the inner core 42 projects a maximum stroke toward the bottom 12*a* under the action of the first cylinder 38, the first and second split cores 46, 50 jointly take on a cylindrical shape. The first and second split cores 46, 50 are of a substantially columnar shape of equal length which extends axially, and have upper portions inserted in the cylindrical hole 26*a* defined in the movable die 26. When the inner core 42 is drawn out, the first and second split cores 46, 50 are attracted toward the axial center C with a predetermined time difference by first engaging members 67 and second engaging members 66. Such movement will be described in detail later.

Each of the first split cores 46 has an outer side surface 46*a*, an inner slanted surface 46*b*, and circumferentially side surfaces 46*c*, 46*d*. The outer side surface 46*a* is of an arcuate shape subtending an angle of about 20° at the axial center C. The circumferentially side surfaces 46*c*, 46*d* are surfaces which are progressively closer in a direction away from the axial center C such that each of the first split cores 46 has a substantially trapezoidal cross-sectional shape having a distal end portion tapered outwardly. Each of the first split cores 46 may have at least a tapered distal end portion.

Each of the second split cores 50 has an outer side surface 50*a*, an inner central slanted surface 50*b*, an inner first side surface 50*c* held in abutment against the circumferentially side surface 46*c*, and an inner second side surface 50*d* held in abutment against the circumferentially side surface 46*d*. The outer side surface 50*a* is of an arcuate shape subtending an angle of about 160° at the axial center C. Each of the second split cores 50 has a substantially crescentic cross-sectional shape.

The inner slanted surfaces 46*b* of the first split cores 46 and the inner central slanted surfaces 50*b* of the second split cores 50 are gradually inclined closely to the axial center C in a direction toward the bottom 12*a*, at an angle equal to the angle of inclination of the first outer slanted surfaces 42*a* and the second outer slanted surfaces 42*b* of the inner core 42. The first outer slanted surfaces 42*a* and the inner slanted surfaces 46*b* are held against each other, and the second outer slanted surfaces 42*b* and the inner central slanted surfaces 50*b* are held against each other. The inner slanted surfaces 46*b* have first engaging grooves 48 defined therein which extend in the direction toward the bottom 12*a* parallel to the inner slanted surfaces 46*b*. Similarly, the inner central slanted surfaces 50*b* have second engaging grooves 52 defined therein which extend in the direction toward the bottom 12*a* parallel to the inner central slanted surfaces 50*b*. Each of the first engaging grooves 48 and the second engaging grooves 52 is of a T-shaped cross section having a bifurcated inner portion.

First engaging members 67 of a T-shaped cross section which engage respectively in the first engaging grooves 48 are partly embedded in and fastened by bolts 69 to the respective first outer slanted surfaces 42*a* of the inner core 42 near its distal end. Similarly, second engaging members 66 of a T-shaped cross section which engage respectively in the second engaging grooves 52 are partly embedded in and fastened by bolts 69 to the respective second outer slanted surfaces 42*b* of the inner core 42 near its distal end.

Figure 5:
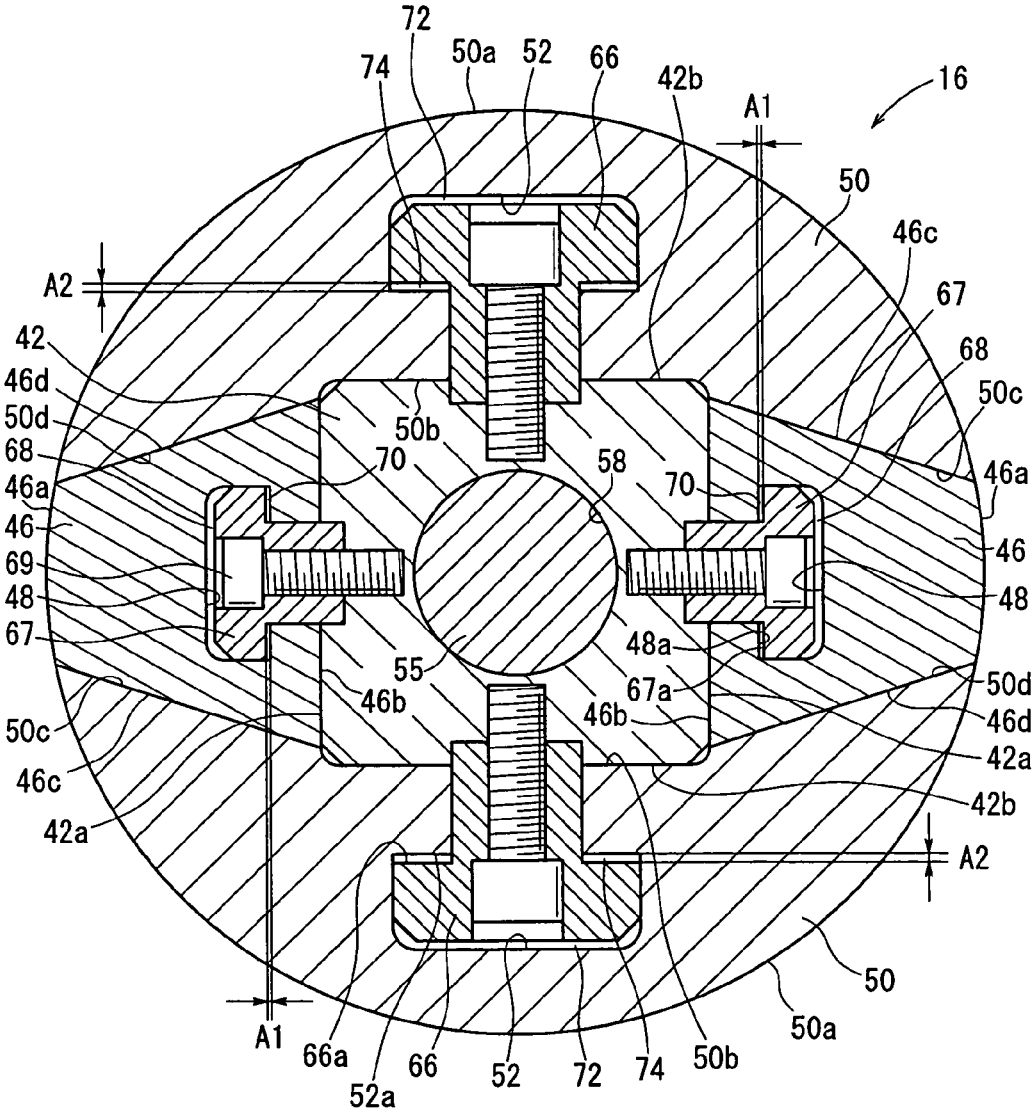
FIG. 5 is a sectional plan view of the split core assembly with the inner core being pushed out.

As shown in FIG. 5, radially-outside first outer gaps 68 and radially-inside first inner gaps 70 are present in laterally extending portions of the T-shaped cross section between the first engaging members 67 and the first engaging grooves 48. Radially-outside second outer gaps 72 and radially-inside second inner gaps 74 are present in laterally extending portions of the T-shaped cross section between the second engaging members 66 and the second engaging grooves 52. The first inner gaps 70 have a width A1 which is smaller than a width A2 of the second inner gaps 74.

The inner slanted surfaces 46*b* of the first split cores 46 are held in abutment against the first outer slanted surfaces 42*a* of the inner core 42. The first split cores 46 are slightly pressed radially outwardly by the inner core 42. The first split cores 46 have upper portions held against and positioned by inner surfaces of the cylindrical hole 26*a* in the movable die 26.

The inner central slanted surfaces 50*b* of the second split cores 50 are held in abutment against the second outer slanted surfaces 42*b* of the inner core 42, and the inner first side surfaces 50*c* and the inner second side surfaces 50*d* of the second split cores 50 are held in abutment against the circumferentially side surfaces 46*c*, 46*d* of the first split cores 46. The second split cores 50 are slightly pressed radially outwardly by the inner core 42 and the first split cores 46. Since the inner core 42 is of a downwardly tapered shape, when the inner core 42 is pressed downwardly, the first split cores 46 are pushed outwardly by the first outer slanted surfaces 42*a*. Since the first split cores 46 are tapered radially outwardly, the second split cores 50 are pushed in directions perpendicularly to the directions in which the first split cores 46 are moved. Therefore, the inner first side surfaces 50*c* and the inner second side surfaces 50*d* of the second split cores 50 are pushed radially outwardly while sliding against the circumferentially side surfaces 46*c*, 46*d* of the first split cores 46. The inner first side surfaces 50*c* and the circumferentially side surfaces 46*c*, and the inner second side surfaces 50*d* and the circumferentially side surfaces 46*d* are reliably held in abutment against each other without any clearance therebetween. The first split cores 46 and the second split cores 50 jointly make up a cylinder with little gaps in seams on the outer circumferential surface thereof.

Figure 6:
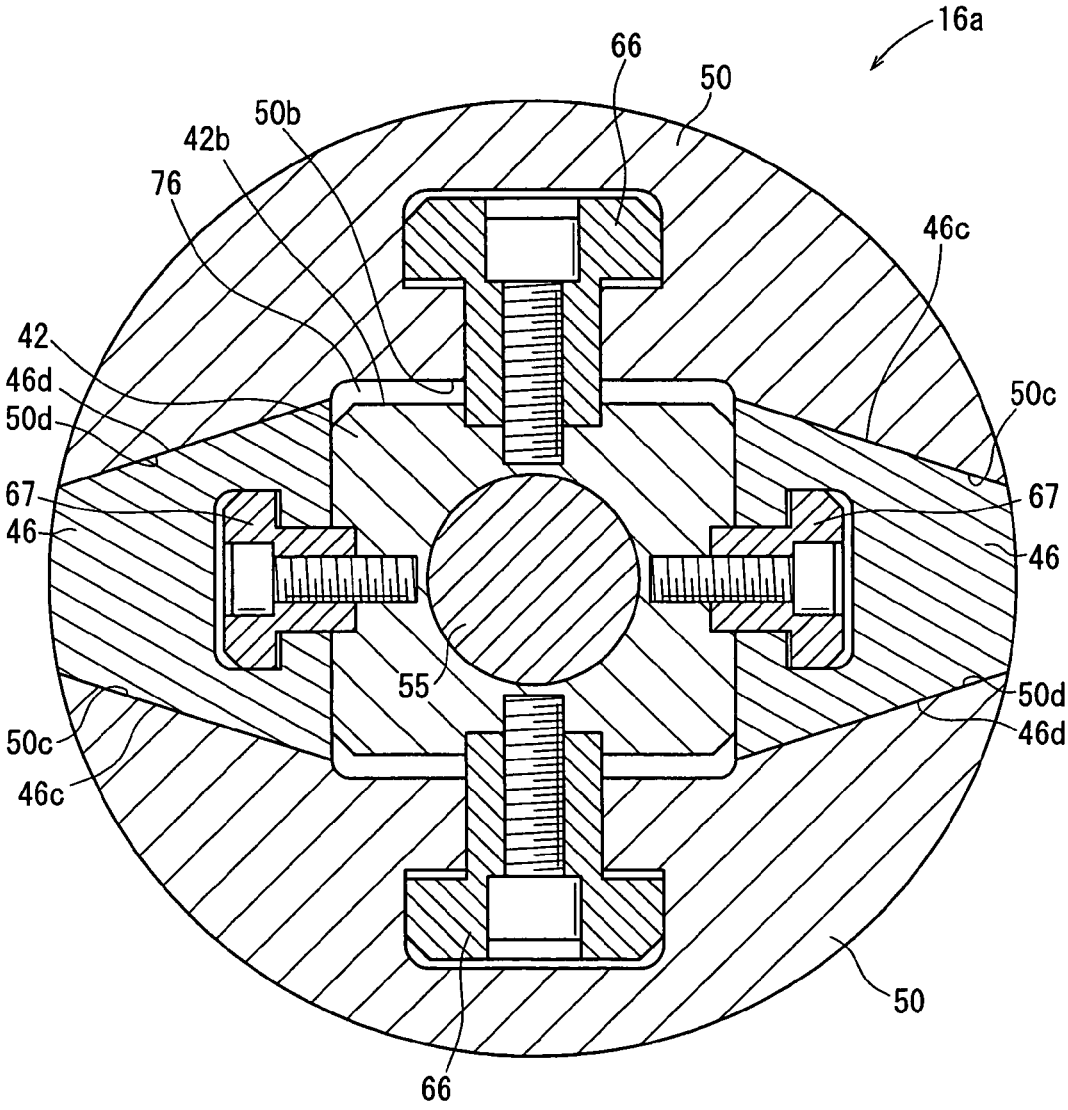
FIG. 6 is a sectional plan view of a split core assembly according to a first modification.
Figure 13:
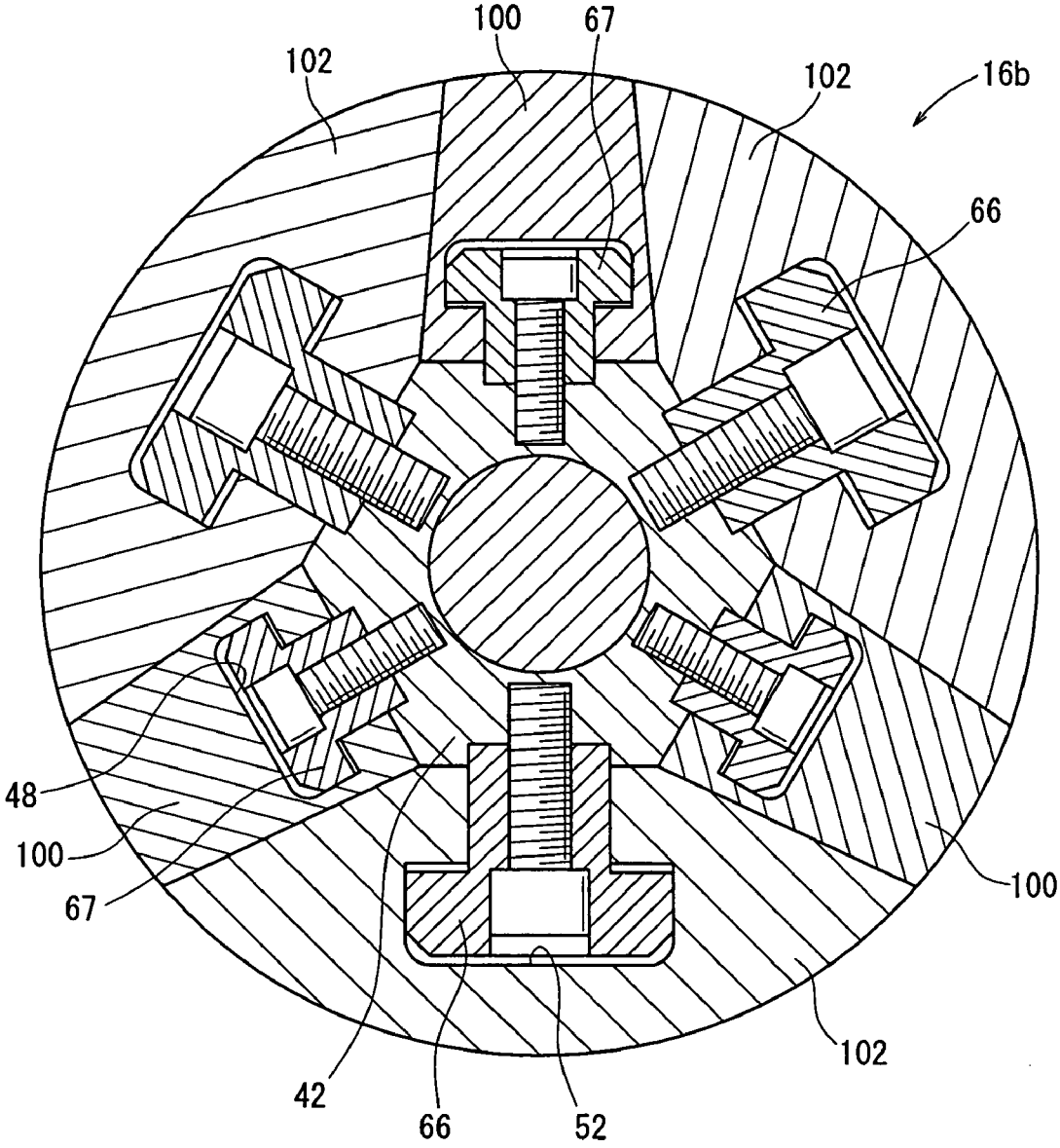
FIG. 13 is a sectional plan view of a split core assembly according to a second modification.
Figure 14:
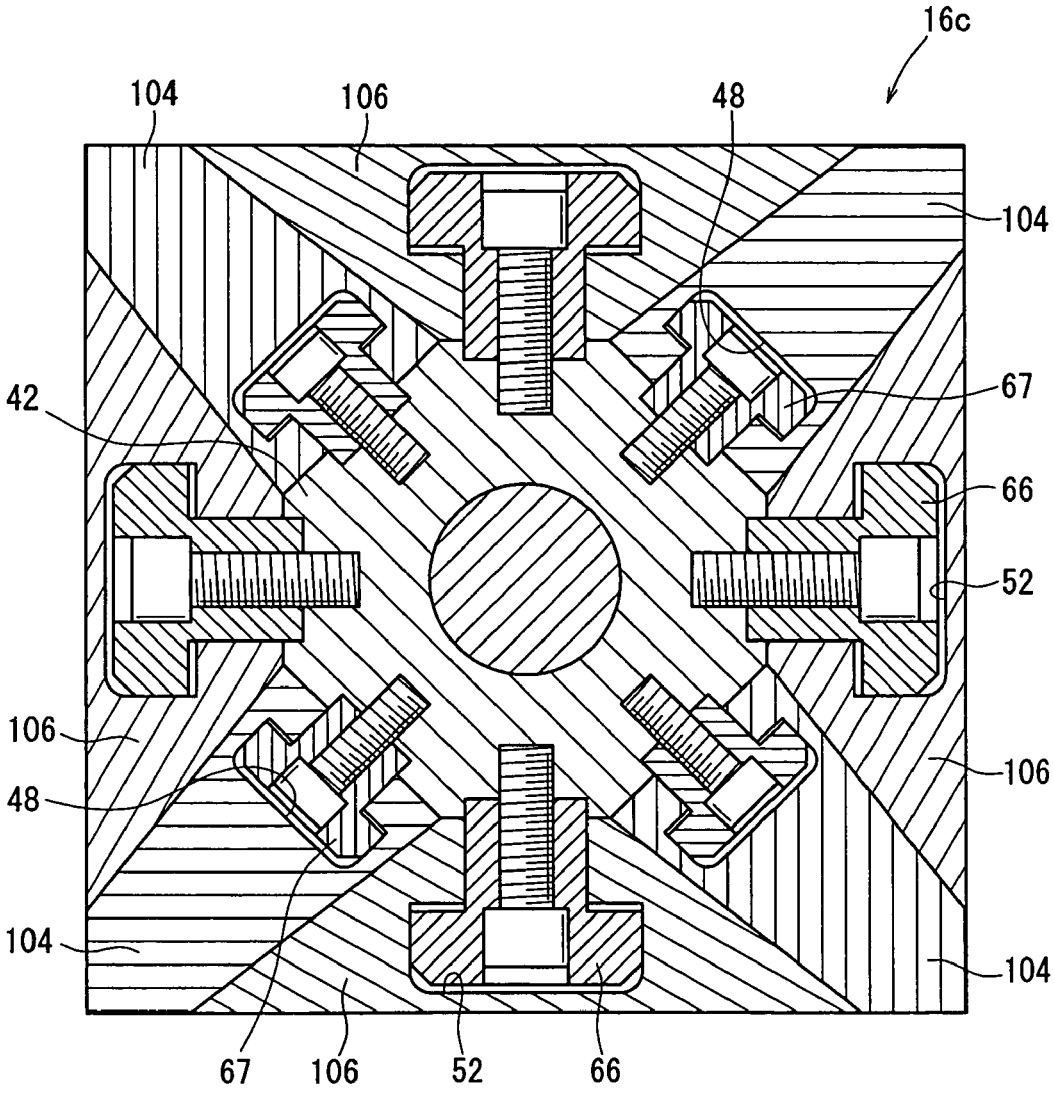
FIG. 14 is a sectional plan view of a split core assembly according to a third modification.

In a split core assembly 16*a* shown in FIG. 6, gaps 76 may be provided between the second outer slanted surfaces 42*b* of the inner core 42 and the inner central slanted surfaces 50*b* of the second split cores 50 for causing the second split cores 50 to be pushed radially outwardly by only the first split cores 46. The first split cores 46 and the second split cores 50 are further reliably brought into abutment against each other, reducing gaps in seams on the outer circumferential surface. In FIG. 6 and FIGS. 13, 14 to be described later, those parts which are identical to those of the split core assembly 16 are denoted by identical reference characters, and will not be described in detail.

The first engaging members 67 and the first engaging grooves 48 may be provided in reverse positions. Specifically, the first engaging members 67 may be provided so as to project inwardly from the inner slanted surfaces 46*b* of the first split cores 46, and the first engaging grooves 48 may be defined in the first outer slanted surfaces 42*a* of the inner core 42. In this case, the first engaging members 67 may be disposed on upper portions of the inner slanted surfaces 46*b*. The second engaging members 66 and the second engaging grooves 52 may also be provided in reverse positions.

A ring (second stopper) 78 having a central square hole 78*a* defined therein has a lower surface held against upper surfaces of the first split cores 46 and the second split cores 50. Four pins 80 which are spaced at equal distances are press-fitted in an upper portion of the ring 78 and project upwardly. The inner core 42 extends through the central square hole 78*a*.

The ring 78 and upper portions of the first split cores 46 and the second split cores 50 are inserted in the cylindrical hole 26*a*, and slightly project upwardly beyond the movable die 26.

The suspension member 64 has a central portion fastened to an upper surface of the pole 55 by a bolt 81. The suspension member 64 projects horizontally in opposite directions from a portion thereof which is sandwiched between the upper side blocks 60 through recesses 78*b* defined in the upper surface of the ring 78. The suspension member 64 has opposite ends inserted in the vertical grooves 26*b*, 36*c* for vertical movement along the vertical grooves 26*b*, 36*c*. The opposite ends of the suspension member 64 are fixed to the movable die 26 by bolts 82. A gap is provided between the lower surface of the suspension member 64 and the upper surface of the ring 78.

Two substantially semicircular spring seats 86 that are slightly spaced from each other are mounted on an upper surface of the base plate 36, and provide a diametrically split circle around the inner core 42, essentially closing an upper end of the cylindrical hole 36*b*. Each of the spring seats 86 has an outer circumferential portion fixed to the base plate 36 by a plurality of bolts 65.

Each of the spring seats 86 has two vertically through holes 86*a* defined in a radially inner portion thereof, and the pins 80 are partly inserted in the through holes 86*a*. Springs 88 are disposed around the pins 80 and compressed between the lower surfaces of the spring seats 86 and the upper surface of the ring 78, pressing the ring 78 downwardly. The pins 80 have respective upper end surfaces located in positions slightly lower than the upper surfaces of the spring seats 86.

The method of manufacturing a cylinder block using the die apparatus 10 thus constructed will be described below. The processing sequence of the method is carried out in the order of step numbers shown.

Figure 7:
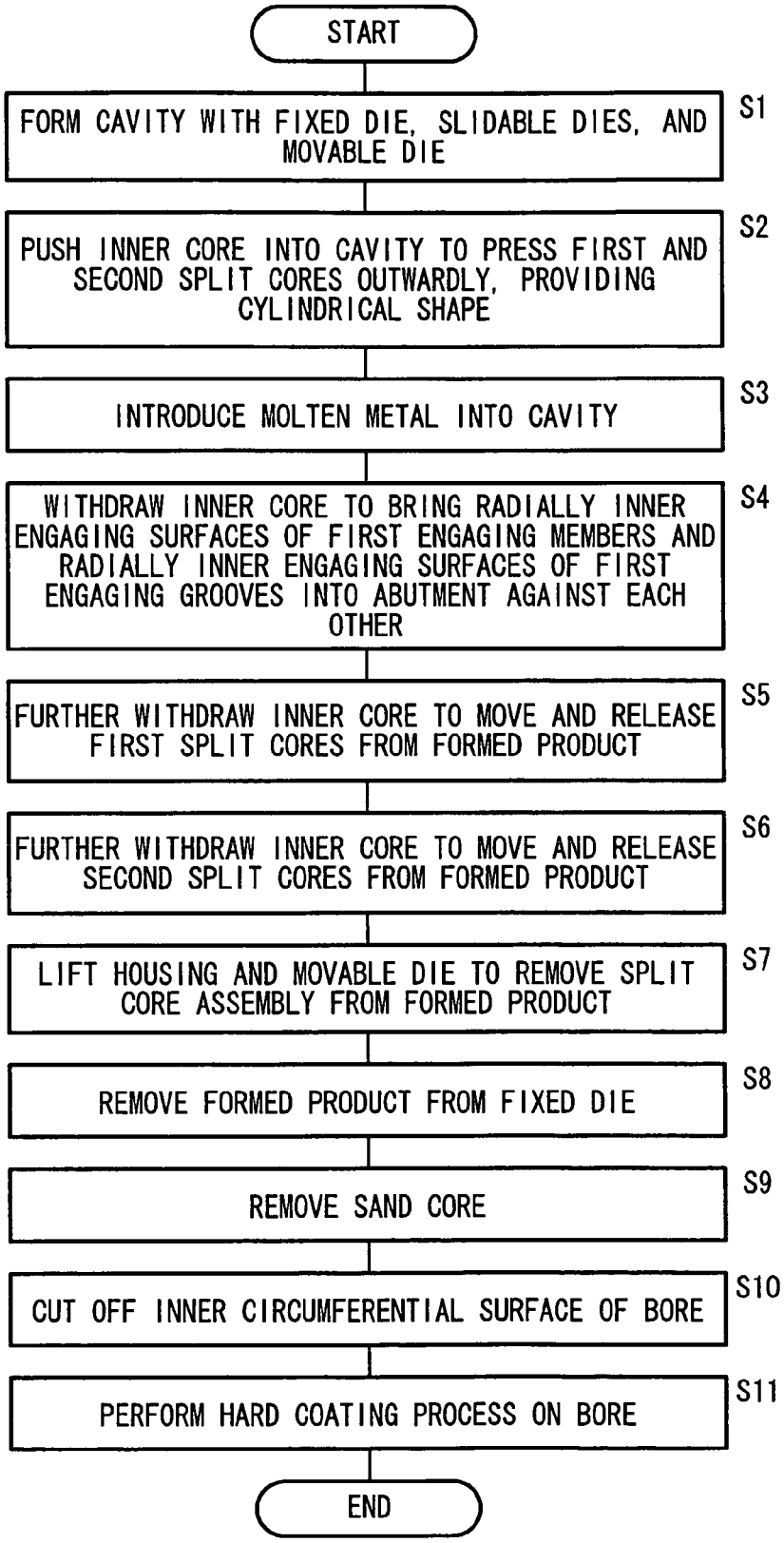
FIG. 7 is a flowchart of a method of manufacturing a cylinder block according to an embodiment of the present invention.
Figure 8:
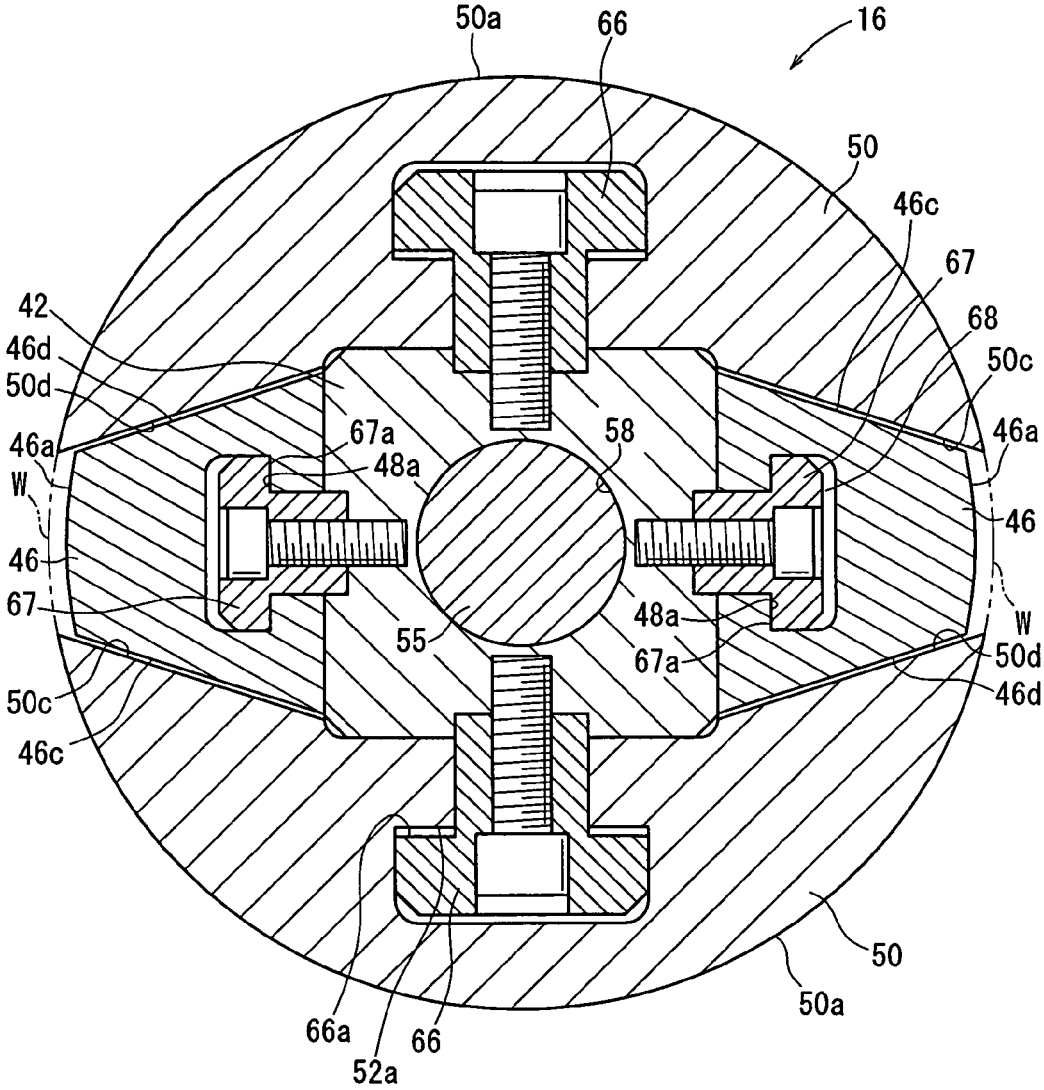
FIG. 8 is a sectional plan view of the split core assembly with only a first split core being released.

In step S1 shown in FIG. 7, the first slidable die 22 and the second slidable die 24 are slidingly moved, and the movable die 26 is lowered by the second cylinder 40, so that the fixed die 20, the first slidable die 22, the second slidable die 24, and the movable die 26 jointly form the cavity 12.

The split core assembly 16 which has the distal end core 54, the first split cores 46, and the second split cores 50 is inserted through the cylindrical hole 36*b* and the cylindrical hole 26*a* into the cavity 12. The first split cores 46 and the second split cores 50 are pressed downwardly into abutment against the upper surface of the distal end core 54 by the springs 88.

In step S2, the first cylinder 38 is actuated to lower the rod 38*a* until the stopper 62 abuts against the spring seats 86, pushing the inner core 42 into the cavity 12. The first split cores 46 and the second split cores 50 are pressed outwardly by the inner core 42 while being limited against movement toward the bottom 12*a* by the distal end core 54, jointly providing a cylindrical shape complementary to the shape of the inner circumferential surface of the bore B. The outside diameter of the cylindrical shape is established in view of an amount of material to be cut off in a cutting process in step S10, to be described later, and a rate of shrinkage at the time the molten metal is solidified. The outer circumferential surface of the cylindrical shape is of a shape free of a slanted surface which corresponds to the draft angle of the conventional core.

In step S3, a molten metal is introduced from the gate 28 into the cavity 12. When the molten metal is cooled and solidified, a formed product W is cast as a cylinder block. Only the distal end core 54 is provided in the portion of the formed product which corresponds to the combustion chamber of the cylinder head, the combustion chamber is of a flash-free smooth shape.

Since the first split cores 46 and the second split cores 50 are of a cylindrical shape with no draft angle, no unnecessary wall thickness is provided around the bore B, and no shrinkage cavities are formed when the molten metal is solidified.

A small amount of molten metal enters the gaps between the first split cores 46 and the second split cores 50, the gaps between the distal end core 54 and the first split cores 46, and the gaps between the distal end core 54 and the second split cores 50, producing flash on the outer circumferential surface of the cylindrical shape. However, such flash will easily be removed in step S10 to be described later.

In step S4, the inner core 42 is withdrawn by the first cylinder 38. Therefore, radially inner engaging surfaces 67*a* of the first engaging members 67 and radially inner engaging surfaces 48*a* of the first engaging grooves 48, which face each other across the first inner gaps 70, are brought toward and abut against each other (see FIG. 8).

Since the initial width A1 of the gaps between the radially inner engaging surfaces 67*a* and the radially inner engaging surfaces 48*a* is smaller than the initial width A2 of the gaps between radially inner engaging surfaces 66*a* of the second engaging members 66 and radially inner engaging surfaces 52*a* of the second engaging grooves 52, when the radially inner engaging surfaces 67*a* and the radially inner engaging surfaces 48*a* abut against each other, the radially inner engaging surfaces 66*a* and the radially inner engaging surfaces 52*a* are spaced by a gap from each other.

In step S5, after the radially inner engaging surfaces 67*a* and the radially inner engaging surfaces 48*a* abut against each other, the inner core 42 is further withdrawn to cause the first engaging members 67 to move upwardly in the first engaging grooves 48. As the first split cores 46 have their upper surfaces resiliently pressed by the ring 78 and the springs 88, the first split cores 46 are prevented from being pulled out of the cavity 12. Since the first engaging grooves 48 are inclined radially outwardly in the upward direction, the first split cores 46 are attracted under forces directed from the first engaging members 67 toward the axial center C, and the outer side surfaces 46*a* are released from the formed product W (see FIG. 8).

At this time, since the second split cores 50 receive no forces from the second engaging members 66, the second split cores 50 do not move, and the outer side surfaces 50*a* of the second split cores 50 are not released from the formed product W. There are produced gaps between the circumferentially side surfaces 46*c* of the first split cores 46 and the inner first side surfaces 50*c* of the second split cores 50 and also between the circumferentially side surfaces 46*d* of the first split cores 46 and the inner second side surfaces 50*d* of the second split cores 50.

Figure 9:
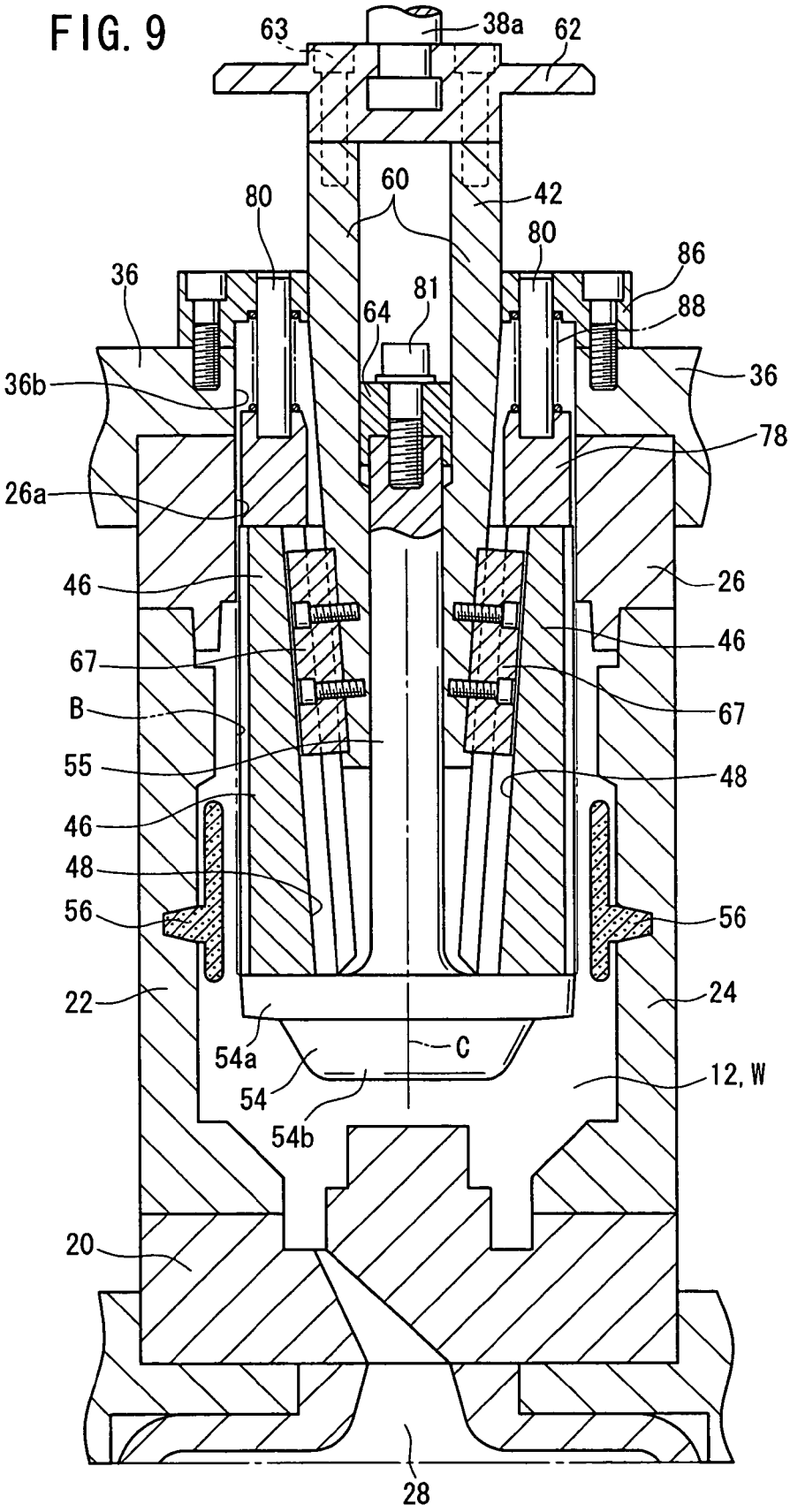
FIG. 9 is a sectional side elevational view of the fixed die, the slidable dies, the movable die, and the split core assembly with the inner core being withdrawn.
Figure 10:
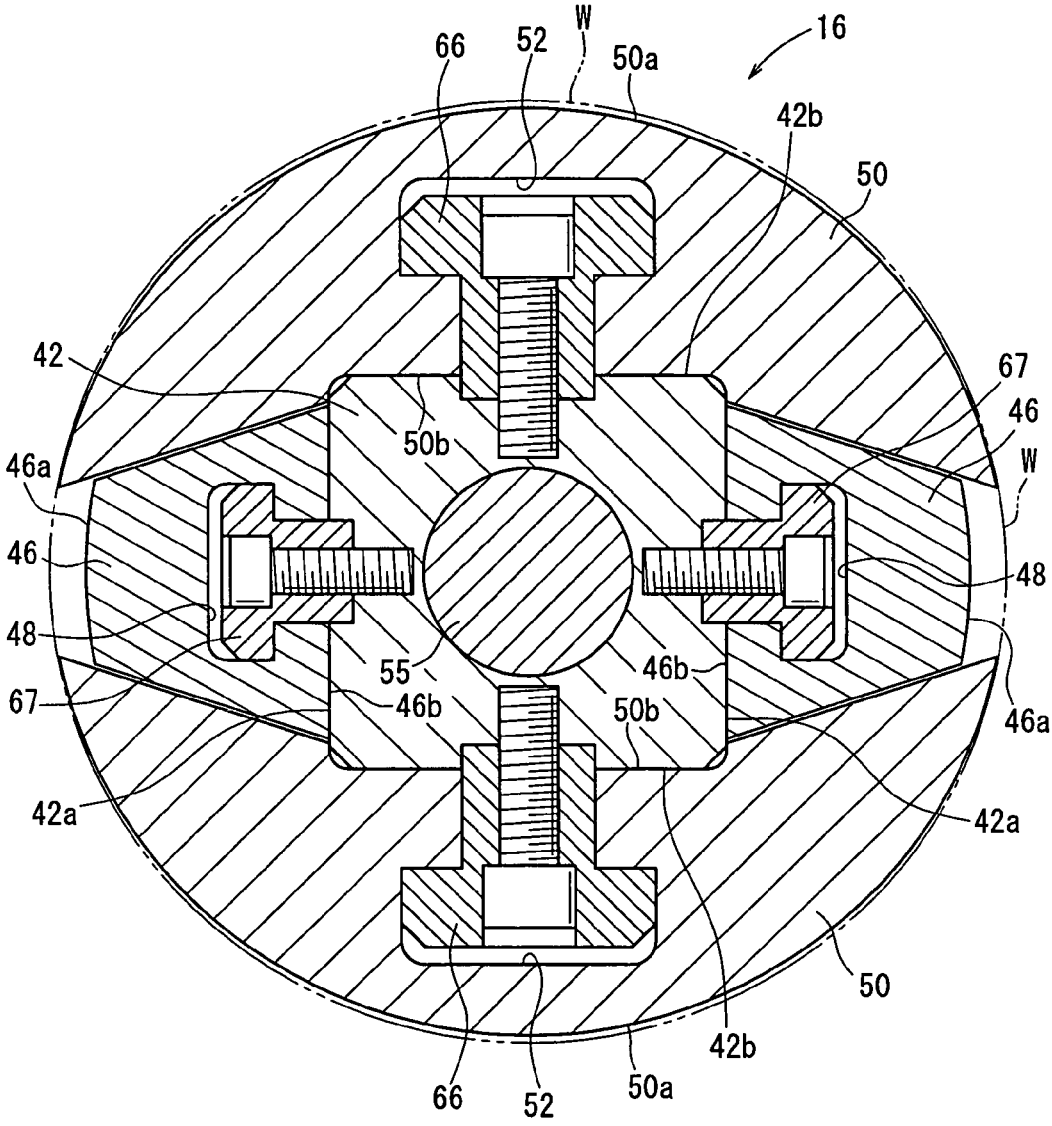
FIG. 10 is a sectional side elevational view of the split core assembly with first and second slit cores being released.

In step S6, as shown in FIG. 9, the inner core 42 is further withdrawn to move the second engaging members 66 upwardly in the second engaging grooves 52, bringing the radially inner engaging surfaces 66*a* into abutment against the radially inner engaging surfaces 52*a*. The second split cores 50 are prevented from being removed out of the cavity 12 because the upper surfaces of the second split cores 50 are resiliently pressed by the ring 78 and the springs 88 as with the first split cores 46. Because the second engaging grooves 52 are inclined radially outwardly in the upward direction, the second split cores 50 are attracted under forces directed from the second engaging members 66 toward the axial center C, and the outer side surfaces 50*a* are released from the formed product W (see FIG. 10). In FIG. 9, for the sake of brevity, the formed product W is illustrated as a hollow part as with the cavity 12.

When the casting process is finished (step S3), the outer side surfaces 46*a* of the first split cores 46 and the outer side surfaces 50*a* of the second split cores 50 are fixedly held in contact with the formed product W, and forces for overcoming the fixing forces are required to release the first and second split cores 46, 50 from the formed product W. In the die apparatus 10, since the second split cores 50 are released (step S6) with a certain time difference after the first split cores 46 are released (step S5), forces for overcoming fixing forces depending on the area of the outer side surfaces 46*a* of the first split cores 46 are sufficient in step S5, and forces for overcoming fixing forces depending on the area of the outer side surfaces 50*a* of the second split cores 50 are sufficient in step S6. Stated otherwise, as forces required to release the first and second split cores 46, 50 from the formed product W are scattered over time, the first and second split cores 46, 50 can easily be released, and the first cylinder 38 for actuating the inner core 42 may be of a small actuating force generating capability.

The width A1 may not necessarily be smaller than the width A2 (see FIG. 5). The width A1 and the width A2 may be equal to each other, and the angle of inclination of the first outer slanted surfaces 42*a* and the inner slanted surfaces 46*b* and the angle of inclination of the second outer slanted surfaces 42*b* and the inner central slanted surfaces 50*b* may be different from each other for allowing the first split cores 46 to be released earlier than the second split cores 50.

When the first split cores 46 are released, the circumferentially side surfaces 46*c*, 46*d* of the first split cores 46 are spaced from the inner first side surfaces 50*c* and the inner second side surfaces 50*d*. Therefore, these surfaces do not slide against each other and can smoothly be released without being subjected to frictional forces which would otherwise be applied if the surfaces slide against each other.

When the second split cores 50 are released, the first split cores 46 have already been moved, and gaps are produced as moving clearances between the first split cores 46 and the second split cores 50. The second split cores 50 can thus be moved radially inwardly.

The first split cores 46 and the second split cores 50 do not need a draft angle as they move radially inwardly. Therefore, a gradient-free cylindrical bore is formed in the formed product W.

Inasmuch as the first split cores 46 and the second split cores 50 are resiliently pressed by the ring 78 and the springs 88, the first split cores 46 and the second split cores 50 can smoothly be operated without being fixed in position when they are released. In other words, the split core assembly 16 serves to convert vertical movement into horizontal movement, and the cores in this operation are prevented by the springs 88 from being fixed in position or inactivated under forces tending to tilt the cores. If it is sufficiently guaranteed that the cores are prevented from being fixed in position or inactivated, then the springs 88 may be dispensed with and the ring 78 may be secured in place.

Steps S4 through S6 have been described under different step numbers for the convenience of illustration. However, these steps belong to a continuous process, and the releasing process is performed simply by withdrawing the inner core 42.

At this time, because the first split cores 46 and the second split cores 50 have already been released from the formed product W, no sticking occurs between the split core assembly 16 and the formed product W regardless of the depth of the bore B.

In step S7, after the inner core 42 is sufficiently withdrawn upwardly, the first cylinder 38 is inactivated, and the second cylinder 40 is actuated to pull the housing 34 and the movable die 26 upwardly. The split core assembly 16 is now removed from the formed product W. At this time, the distal end core 54 is released from the formed product W. Since the cylindrical portion 54*a* of the distal end core 54 is of a sufficiently low axial height, an amount of material to be cut off in step S10 to be described later is small even if the cylindrical portion 54*a* has a draft angle. Furthermore, as the conical base portion 54*b* has a gradient because of its shape, the conical base portion 54*b* can easily be released. The combustion chamber is formed to a smooth shape because there are no seams on the lower surface of the distal end core 54.

In step S8, the first slidable die 22 and the second slidable die 24 are slid and released from the outer circumferential surface of the formed product W, and the formed product W is removed from the fixed die 20. The molten metal which is solidified in the gate 28 remains joined as an unwanted part to the formed product W. The unwanted part is removed according to a predetermined procedure.

In step S9, the sand core 56 is crushed and removed by air, sand blasting, or water jet, whereupon a cooling water jacket in the cylinder is formed.

Figure 11:
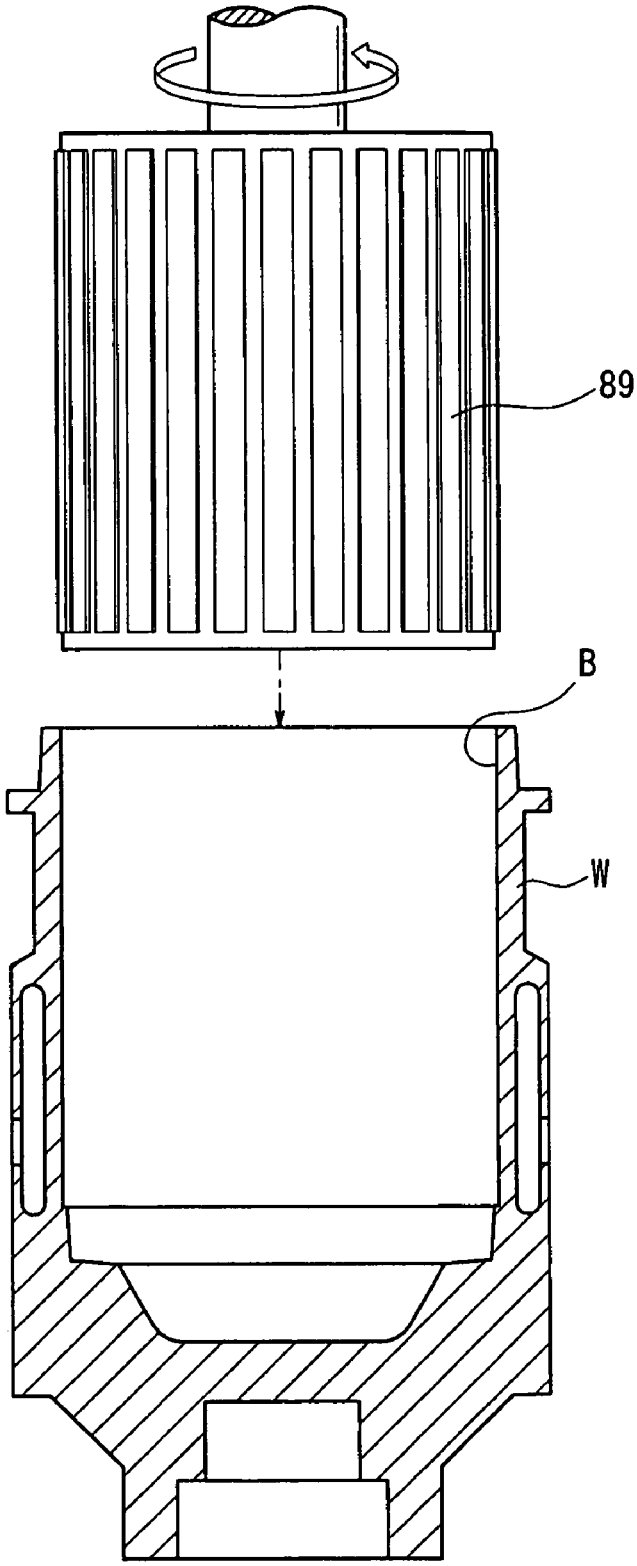
FIG. 11 is a view showing the manner in which a bore is cut.
Figure 12A:
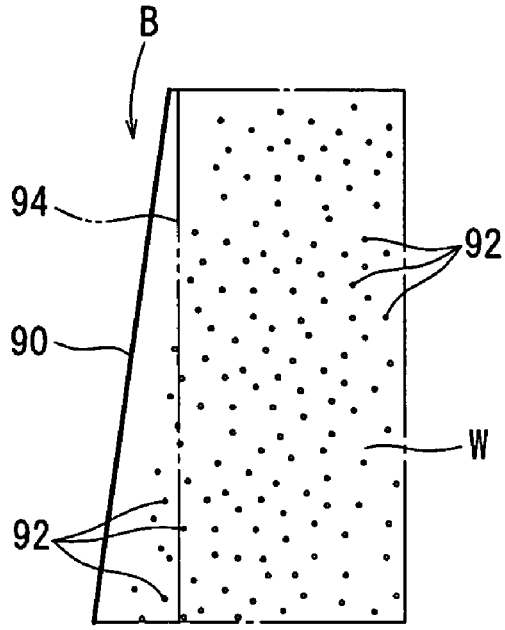
FIG. 12A is a schematic cross-sectional view showing a distribution of blowholes in the case where a casting has a draft angle.

In step S10, as shown in FIG. 11, the inner circumferential surface of the bore B in the formed product W is cut by a tool 89. Since the bore B has been formed to a gradient-free cylindrical shape by the die apparatus 10, the amount of material that is cut off in step S10 is small. If the bore B has a gradient, then, as shown in FIG. 12A, the amount of material that is cut off is smaller in the opening of the bore B, but becomes progressively greater toward the bottom thereof. Since castings tend to contain more blowholes 92 in deeper regions from the surface 90, if the draft angle is large, then a large amount of material is machined off from the casting in some regions, and many blowholes 92 are liable to appear in the cut surface 94 of the casting.

Figure 12B:
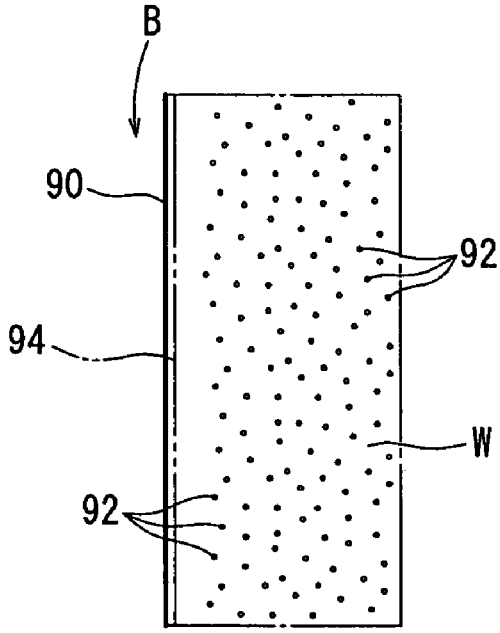
FIG. 12B is a schematic cross-sectional view showing a distribution of blowholes in the case where a casting has no draft angle.

According to the method of manufacturing a cylinder block with the die apparatus 10, as shown in FIG. 12B, since the bore B in the casting is free of gradients, the amount of material that is cut off is small, and almost no blowholes 92 appear in the cut surface 94. Therefore, the cylinder block is of high quality. Furthermore, the machining time is reduced, and the material is saved as the generation of chips etc. is small. Small flash produced at the seams between the first split cores 46 and the second split cores 50 in the above casting process is easily removed in the cutting process.

The cutting process in step S10 represents a process of cutting off the surface of the bore B regardless of the type of the tool, and may include a cutting process, for example.

In step S11, the bore B is protected by being coated by a hard coating process such as a plating or spraying process. At this time, inasmuch as almost no blowholes 92 appear on the inner circumferential surface of the bore B, the hard coating process is performed properly to provide a high-quality surface and an increased yield. As the hard coating process produces an increased sliding capability, the formed product W is preferably used as a cylinder block.

Between step S10 and step S11, the product W may be processed by a heating process in order to remove strains. As almost no blowholes 92 are present on and immediately below the inner circumferential surface of the bore B, the inner circumferential surface can stably be heated and is not unduly deformed. In subsequent step S11, therefore, a proper coating process can be performed on the surface of the bore B.

With the die apparatus 10 and the method of manufacturing a cylinder block according to the present embodiment, as described above, since the first split cores 46 and the second split cores 50 are moved radially inwardly, the shape of the bore B is free of draft angles. Therefore, a deep bottomed bore B can preferably be formed in a cylinder block that is of a structure integral with a cylinder head.

As the bore B is free of draft angles, the amount of material cut off in step S10 is small, and blowholes 92 do not tend to appear on the cut surface.

The split core assembly 16 in the die apparatus 10 is separable into four members (excluding the inner core 42) including the two first split cores 46 and the two second split cores 50. However, as shown in FIG. 13, a split core assembly 16*b* may be separable into six members including three first split cores 100 and three second split cores 102 which are alternately disposed. Basically, furthermore, a split core assembly may be separable into eight or ten members including the same numbers of first split cores and second split cores to provide the same advantages as described above.

The split core assembly 16 has a circular cross-sectional shape. However, the split core assembly 16 may have a desired cross-sectional shape. For example, a split core assembly 16*c* shown in FIG. 14 has a square cross-sectional shape. The split core assembly 16*c* is separable into eight members including first split cores 104 disposed respectively at the four corners and second split cores 106 disposed respectively at the remaining four sides. In substantially same manner as with the split core assembly 16, the first split cores 104 are first moved radially inwardly, and thereafter the second split cores 106 are moved. If a split core assembly is of a triangular cross-sectional shape, not shown, then the split core assembly should preferably be separable into six members.

The inner core 42, the distal end core 54, and the pole 55 of the split core assembly 16 may have coolant passages defined therein, and, during the casting process, a coolant may be supplied to flow through the coolant passage to cool the inner core 42, the distal end core 54, and the pole 55 for increasing the quality of the surface of the bore B. The die apparatus 10 has been described as being applied to the manufacture of a single-cylinder cylinder block. If the die apparatus is to be applied to the manufacture of a cylinder block having a plurality of cylinders, then the die apparatus may have an array of as many split core assemblies 16 as the number of cylinders.

The die apparatus and the method of manufacturing a cylinder block according to the present invention are not limited to the above embodiments, but may have various arrangements without departing from the scope of the invention.

The invention claimed is:

1. A method of manufacturing a cylinder block with a die apparatus comprising a split core assembly inserted into a cavity in a casing die for forming a columnar hole in a casing, said split core assembly including a plurality of first and second split cores, a distal end core, an inner core having a longitudinal axis, and a second stopper, wherein said columnar hole comprises a bore in the cylinder block, said method comprising:

a first step of abutting said first and second split cores against an upper surface of said distal end core, said upper surface being located opposite said inner core:

a second step of introducing a molten metal into said cavity;

a third step of withdrawing said inner core, causing first and second engaging members to move, respectively, into first and second engaging grooves, moving said first split cores and said second split cores toward said axis, and releasing said first split cores and said second split cores from a formed product made of the solidified molten metal;

a fourth step of removing said split core assembly from said formed product to form said bore; and a fifth step of cuffing an inner surface of said bore.

2. A method of manufacturing a cylinder block according to claim 1, further comprising:

after said fifth step, a sixth step of performing a hard coating process on the inner surface of said bore.

3. A method of manufacturing a cylinder block according to claim 2, wherein said hard coating process comprises a plating process.

* * * * *